United States Patent [19]

Bacher

[11] 4,105,960

[45] Aug. 8, 1978

[54] BROAD-BAND CONTINUOUSLY VARIABLE ATTENUATOR

[76] Inventor: Helmut Bacher, 771 Quince Orchard #11, Gaithersburg, Md. 20760

[21] Appl. No.: 752,209

[22] Filed: Dec. 20, 1976

[51] Int. Cl.[2] ..... H01P 1/22

[52] U.S. Cl. ..... 333/81 A; 333/97 R

[58] Field of Search ..... 333/81 A; 338/216

[56] References Cited

U.S. PATENT DOCUMENTS 3,019,402 1/1962 Lanctot ..... 333/81 A

*Primary Examiner*—Paul L. Gensler

*Attorney, Agent, or Firm*—Robert K. Youtie

[57] ABSTRACT

A broad-band variable microwave attenuator wherein outer and inner conductive members define a microwave transmission line, the inner conductive member being interrupted to provide a pair of inner conductor member ends on opposite sides of the interruption, a resistive member extending from the outer conductive member toward the space between the inner conductive member ends, and connector means extending from each inner conductive member end to the resistive member to afford attenuating series and shunt paths.

13 Claims, 5 Drawing Figures

FIG. 3
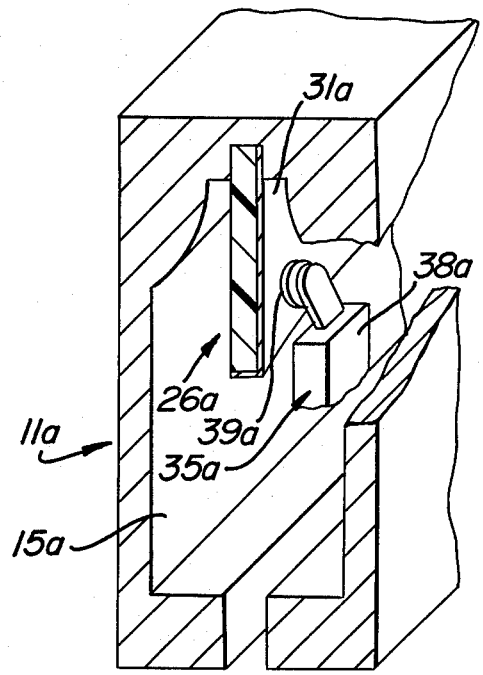
FIG. 4
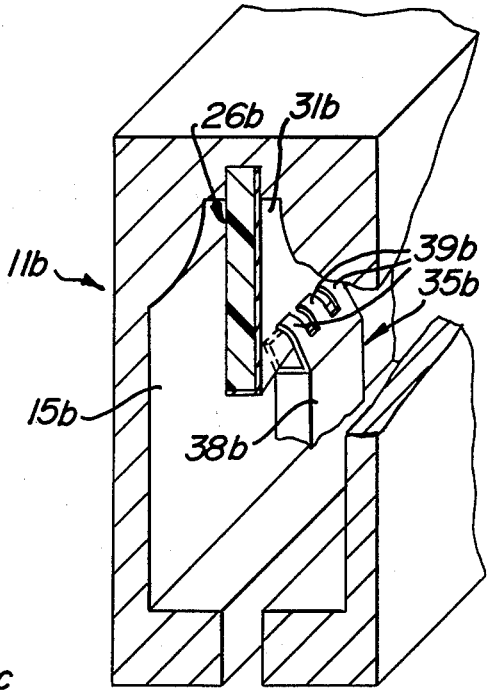
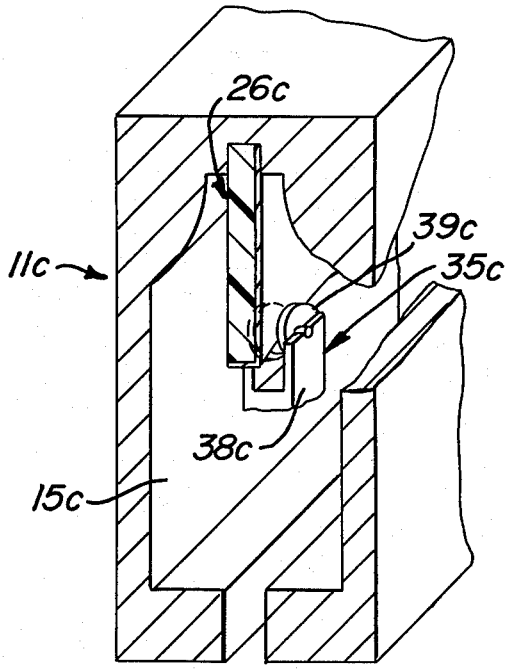
FIG. 5

BROAD-BAND CONTINUOUSLY VARIABLE ATTENUATOR

BACKGROUND OF THE INVENTION

As is well known to those versed in the art, prior variable attenuators have not been entirely satisfactory, being free of distortion only through limited frequency range so that attenuation and standing wave ratio (VSWR) varies as some function of frequency outside of a limited frequency range. In addition, prior variable attenuators have been relatively complex and expensive in construction, and unduly subject to malfunction under actual conditions of use.

SUMMARY OF THE INVENTION

It is, therefore, an important object of the present invention to provide a continuously variable microwave attenuator wherein the attenuation at a given setting is very nearly independent of frequency, the input and output impedance remaining essentially constant and equal to the characteristic impedance of the system from DC to the "moding frequency" modes other than the TEM mode, and otherwise overcome the above-mentioned difficulties.

It is a further object of the present invention to provide a continuously variable attenuator of the type described which has a low minimum insertion loss, can be economically manufactured for sale at a reasonable price, and which is adapted for staunch and sturdy construction capable of long, trouble-free use under severe environmental conditions.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described, and of which the scope will be indicated by the appended claims.

BRIEF DESCRIPTION OF THE DRAWINGS

FIG. 3 is a transverse sectional view, in perspective, showing a slightly modified embodiment of the present invention.

FIG. 4 is a transverse sectional view in perspective, similar to FIG. 3 showing another slightly modified embodiment.

FIG. 5 is another transverse sectional view, in perspective, showing a further embodiment of the present invention.

DESCRIPTION OF THE PREFERRED EMBODIMENTS

Figure 1:
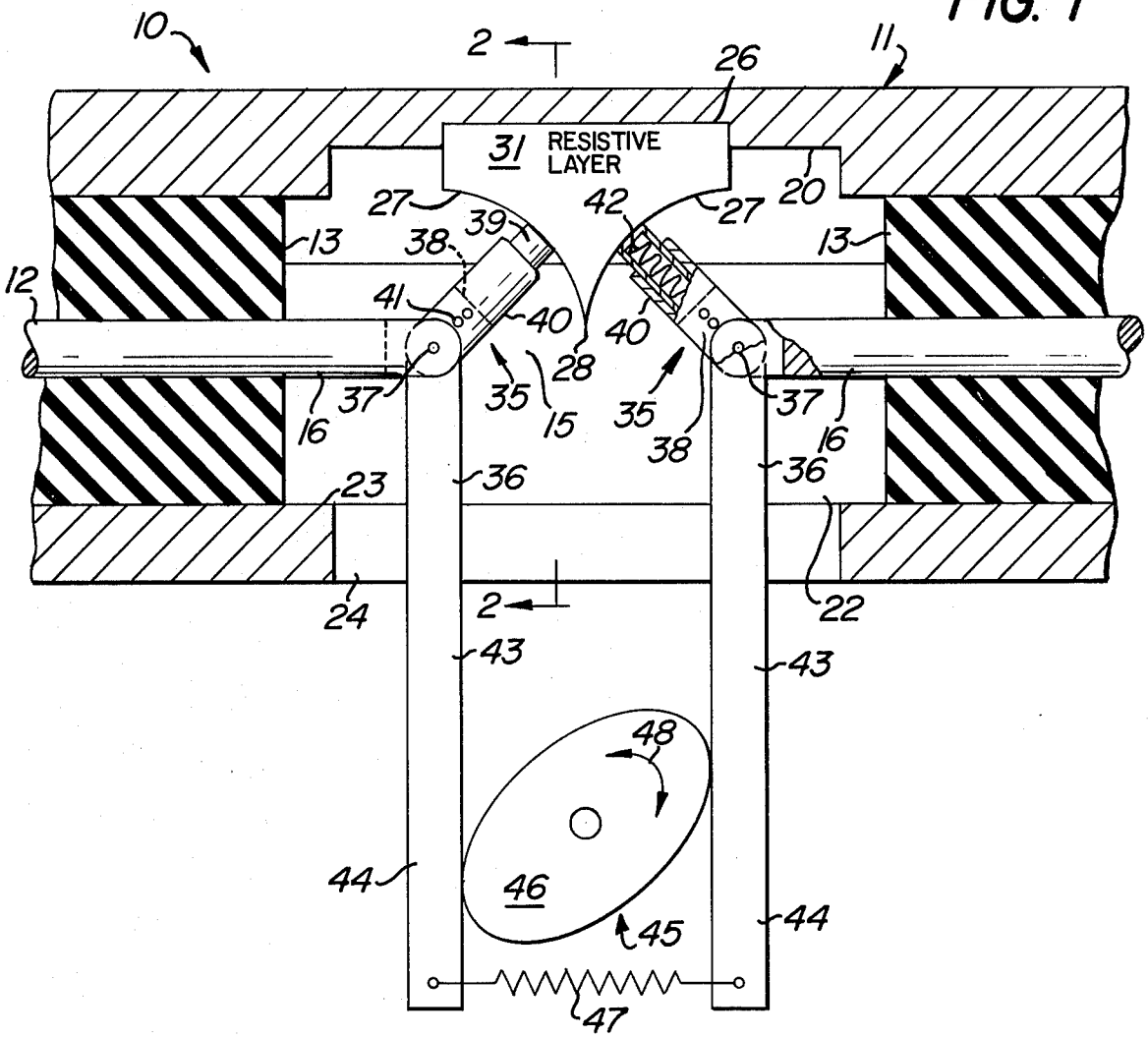
FIG. 1 is a longitudinal sectional view showing a continuously variable microwave attenuator constructed in accordance with the teachings of the present invention.
Figure 2:
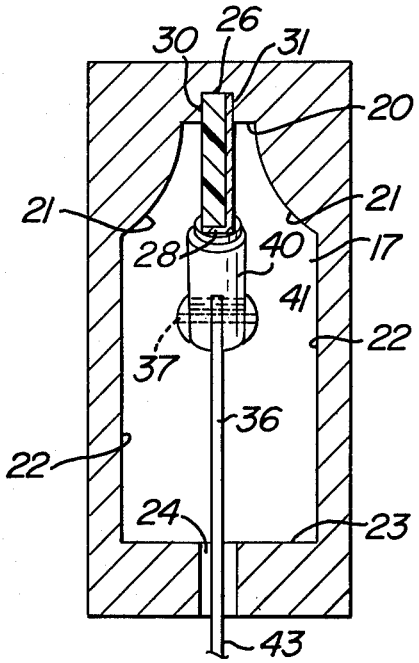
FIG. 2 is a transverse sectional view taken generally along the line 2—2 of FIG. 1.

Referring now more particularly to the drawings, and specifically to FIGS. 1 and 2 thereof, a microwave transmission line generally designated 10, including an outer elongate hollow or tubular conductive member or conductor 11, and an inner elongate conductive member or conductor 12 extending in spaced relation longitudinally within the outer conductor 11, and suitably supported therein by insulating collars or beads 13. As thus far described, the microwave path 10 may be conventional waveguide structure.

The inner conductor 12 may be interrupted or broken away in the space 15, terminating on opposite sides of the interruption in a pair of inner conductor ends 16, 16, in spaced axial alignment with each other. The conductor ends may be bifurcated or clevis-like, if desired.

The outer conductor 11 is provided internally thereof in the region of inner conductor ends 16 with a chamber or cavity 17. The chamber 17 may be of specifically configured cross-section, best seen in FIG. 2, as including a generally horizontal downwardly facing top wall 20 of reduced lateral extent, and a pair of laterally opposed upper side wall regions 21 extending downwardly and outwardly in convexly arcuate configuration. From the lower ends of the upper side wall regions 21 there extend lower inner side wall regions 22 which may be generally planar and parallel, while a generally horizontal upwardly facing bottom wall 23 may extend between the lower ends of the lower side wall regions 22. A longitudinal slot 24 may be provided in the underside of tubular outer conductor 11, opening inwardly through inner bottom wall 23 into cavity 17.

The outer conductive member chamber 17 may be substantially constant in cross-section, and the upper side wall regions 21 may be of downwardly divergent configuration, other than the specific configuration shown, for purposes appearing more fully hereinafter.

Depending from the downwardly facing upper internal chamber surface 20 is a generally flat or plate-like member 26, disposed generally longitudinally within the chamber. That is, the generally flat plate-like member 26 depends in spaced relation between the upper internal wall regions 21 toward the interruption or space 15 between inner conductor ends 16. As best seen in FIG. 1, the plate-like member 126 may be downwardly or inwardly convergent, as between tapering or converging lower edges 27 which terminate at a meeting edge 28 approximately in alignment with and equally spaced between the inner conductor ends 16. The plate-like member 26 may include a dielectric or insulating body or substrate 30 having a coating or electrically resistive layer 31 on at least one face thereof. The substrate 26 and coating 31 are suitably anchored or fixed in the material of the outer conductor 11 with the resistive layer or coating 31 in electrical contact or connection with the conductive material of the outer conductor. This may be seen in FIG. 2 wherein the conductive layer 31 covers one face of the substrate 30, being in contact with the material of outer conductor 11. Additionally, the resistive layer 31 extends along the inwardly convergent inner edges 27, for purposes appearing presently.

Extending between and electrically connecting each inner conductor end 16 to an adjacent region of plate 26 are respective electrical connector means 35. In particular, each electrical connector means 35 electrically connects its adjacent inner conductor end 16 to the adjacent convergent conductive edge 27 of plate 26. Suitable means are provided for electrically connecting each connector means 35 between its adjacent inner conductor end 16 and a selected location along the adjacent resistive edge 27.

One such means may be that of the illustrated angulate lever or bell-type crank 36 each being fabricated of insulating or nonconducting material and pivoted intermediate its ends to a respective inner conductor end 16, as by a pin 37 fixed to the conductor end 16. One arm 38 of each nonconductive crank 36 extends generally from the pivotal connection 37 toward and terminates short of the adjacent resistive edge 27 of plate 26. A pair of conductive extensions 40 is each of bifurcated configuration and longitudinally astride the free end of a respective arm 38 with its legs extending between and in frictional electrically conductive engagement with the clevis legs of the adjacent conductive end 16. The legs of each extension 40 may be fixed to the received arm 38 by suitable means, such as rivets 41, and the opposite end of each extension may be provided with electrically conductive hollow contact element or button 39 engaging the adjacent resistive edge 27 and yieldably maintained in electrical contact therewith by suitable resilient means, such as a coil compression spring 42 interposed between the extension 40 and the contact member or button 39. Each pivot pin 37 may be a slide fit in associated extension 40 and crank 36, which cooperates with the frictional engagement between each end 16 and extension 40 to minimize and compensate for discontinuities along the transmission line.

In the illustrated embodiment, the resistive edges 27 may each be of generally circular concave arcuate configuration, with the associated pivot 37 at the respective center of curvature, and the lever arms 38 and extensions 40 are rotative about the pivots 37 while the contacts 39 are maintained in electrical engagement with the resistive edges 27 by the resilient means 42. Of course, other electrical connector means 35 may be employed, as will appear more fully hereinafter.

Each angulate lever or crank 36 may further include an insulating or nonconducting extension 43 projecting from inner, pivoted end of arm 38 generally toward and spacedly through the slot or opening 24. Extending from each arm 43 may be an operating member or extension 44 which projects beyond the slot 24, exteriorly of the outer member 11 for remote actuation, as desired. For example, a suitable operating means 45 may be operatively connected to the extensions 44 exteriorly of the outer conductor member 11 to operate the connector means 35 by rotating the same in predetermined relation with respect to each other. In the illustrated embodiment, the operating means 45 may include a rotative, generally elliptical cam 46 interposed between the extensions 44 in bearing engagement with the latter, there being suitable means such as a tension spring 47 maintaining the extensions in said cam bearing engagement. Upon selected rotation of the cam 46, as indicated by the arrows 48, the connector means 35 are caused to swing about pivots 37 toward and away from each other while maintaining electrical connection between respective connector ends 16 and the resistive member 31. The charge on member 46 may be such that a linear relationship between turning angle and attenuation is obtained. Of course, other suitable operating means may be employed for actuating the connector means 35, such as feed screw means, step relay means, or other.

It will now be appreciated that, as the connector means 35 swing about their respective axes 37 toward each other, a series conductive path directly between the contacts 39 through the resistive member 31 is of decreasing length, and consequently of decreasing resistance, to the point of no resistance when contacts 39 meet at edge 28. The edge 28 may have a high conductive coating on top of the resistive coating to assure a low resistance series path. Simultaneously, the shunt paths of current, as from each contact 39 through resistive member 31 to outer conductive member 11, are increasing in both distance and value. Further, as the connector means 35 swing away from each other, the shunt path decreases while the series path increases. Although the resistive edges 27 have been illustrated and described as of circular arcs, such configuration is not essential to all conditions, and may be varied, as desired, say being straight or of other configuration to achieve a preferred variation of shunt path with resistance path. Additionally, desired variation of series and shunt resistances as a function of setting of operating means 45, may be predetermined by a selected pattern of thickness variation of resistive coating 31, as well as a pattern or configuration of openings in the resistive coating or film. Of course, the resistive coating or film may be deposited on both sides of substrate 30, and specifically patterned with openings and/or thickness variations, as desired to achieve a required frequency response.

In addition to the above-described two-dimensional variable configuration for achieving desired operating characteristics, an additional dimension is presented in the cross-sectional configuration of the cavity 15. More specifically, as best seen in FIG. 2, the maintenance of desired impedances and flatness of attenuation against frequency is maintained by a specific configuration of internal cavity surface 21 facing toward the resistive plate 26. That is, the configuration of surfaces 21 is optimized for each point in relation to the location of contact 39 with resistive member 31.

While the contacts 39 may be sliding in nature, say of conventional potentiometer, to achieve substantially pure resistance, other contacts may also be employed, if preferred.

For example, in FIG. 3 there is shown an outer conductive member **11*a* having an internal cavity 15*a* and provided therein with a resistive member or plate 26*a*, all of which may be substantially identical to the corresponding structure of the first described embodiment. However, electrical connector means 35*a* may include a swingable arm 38*a* provided on its outer end with a button-type contact 39*a*, say of carbon filled with metal, and in slidable surface engagement with the resistive film or layer 31*a*. The carbon button contact 39*a*** may be advantageous under conditions requiring substantial wear resistance and power handling.

Another possible electrical connector means is generally designated **35*b* in FIG. 4. There is shown therein an outer conductor 11*b* formed with cavity 15*b* and provided therein with a resistive plate 26*b*. The conductor means 35*b* may include a swingable arm 38*b* provided on its outer end with a plurality of resilient extensions or spring contact fingers 39*b* in bearing engagement with the resistive coating 31*b***. The contact fingers may be fabricated of suitable resilient conductive material, such as berylium copper, and may be advantageous in minimizing electrical noise.

A further embodiment is shown in FIG. 5 wherein an outer conductor **11*c* is provided in its cavity 15*c* with a resistive plate 26*c* conductor means 35*c* in the nature of a swinging arm 38*c* and a roller contact 39*c* are provided, with the roller contact engaging the resistive member 26*c*. The roller contact 39*c* may include a conductive groove in rolling engagement with the resistive edge of plate 26*c***, the rolling contact minimizing friction and wear while maintaining relatively low inductance.

From the foregoing, it will now be appreciated that the present invention provides a continuously variable microwave attenuator which is very nearly independent of frequency, being capable of design so that input and output impedance remain essentially constant and equal to the characteristic impedance of the system from DC to the "moding frequency", and otherwise fully accomplishes its intended objects.

Although the present invention has been described in some detail by way of illustration and example for purposes of clarity of understanding, it is understood that certain changes and modifications may be made within the spirit of the invention.

What is claimed is:

1. A variable microwave attenuator comprising an outer conductive member, an inner conductive member extending longitudinally of said outer conductive member and combining therewith to define a microwave transmission line, said inner conductive member being interrupted to provide a pair of spaced inner conductor member ends, a single resistive member electrically connected to said outer conductive member and extending transversely therefrom toward the space between said inner conductor member ends, and an electrical connector means extending from each of said inner conductive member ends to a respective region of said resistive member to provide attenuation series and shunt current paths through said resistive and outer conductive members, at least one of said electrical connector means being continuously movable relative to and in contacting engagement with said resistive member to selectively vary the resistances of said series and shunt paths for selecting the desired attenuation.

2. A variable microwave attenuator according to claim 1, wherein both of said electrical connector means are each movable relative to and in contacting engagement with said resistive member to extend from its associated inner conductive member end to a respective region of said resistive member.

3. A variable microwave attenuator according to claim 2, said resistive member tapering in the direction away from said outer conductive member, and said electrical connector means being movable in said contacting engagement toward and away from said outer conductive member to generally inversely vary said series and shunt paths.

4. A variable microwave attenuator comprising an outer conductive member, an inner conductive member extending longitudinally of said outer conductive member and combining therewith to define a microwave transmission line, said inner conductive member being interrupted to provide a pair of spaced inner conductive member ends, a resistive member electrically connected to said outer conductive member and extending transversely therefrom toward the space between said inner conductive member ends, and an electrical connector means extending from each of said inner conductive member ends to a respective region of said resistive member to provide attenuation series and shunt current paths through said resistive and outer conductive members, both of said electrical connector means each being movable to extend from its associated inner conductive member end to a respective region of said resistive member, said electrical connector means being movable along paths on said resistive member which converge in the direction away from said outer conductive member, to generally inversely vary said series and shunt paths.

5. A variable microwave attenuator according to claim 4, said resistive member being generally planar and having edges converging in the direction away from said outer conductive member, said edges defining said paths on said resistive member.

6. A variable microwave attenuator according to claim 5, said resistive member comprising a dielectric substrate, and a conductive resistive coating on said substrate.

7. A variable microwave attenuator according to claim 6, said coating being configured to keep input and output resistance equal to the characteristic impedance of the connector means position and to change the attenuation versus frequency response.

8. A variable microwave attenuator according to claim 5, said convergent edges being concavely arcuate, and said electrical connector means being pivoted for arcuate movement along said edges.

9. A variable microwave attenuator according to to claim 8, in combination with operating means connected to said electrical connector means for simultaneously moving the latter in equal and opposite directions.

10. A variable microwave attenuator according to claim 5, said outer conductive member being generally tubular, the interior surface of said tubular outer conductive member being configured relative to said planar resistive member to achieve substantially uniform attenuation through a wide range of frequencies.

11. A variable microwave attenuator according to claim 10, wherein said interior surface of said outer conductive member is configured to diverge from said planar resistive member in the direction in which said edges converge.

12. A variable microwave attenuator according to claim 5, said electrical connector means being in sliding contact with said resistive member.

13. A variable microwave attenuator according to claim 5, said electrical connector means being in rolling contact with said resistive member.

* * * * *